United States Patent [19]

Garlinger

[11] Patent Number: 4,936,969

[45] Date of Patent: Jun. 26, 1990

[54] WATER TANK CATHODIC PROTECTION SYSTEM

[75] Inventor: Robert A. Garlinger, Denver, Colo.

[73] Assignee: Harco Technologies Corporation, Medina, Ohio

[21] Appl. No.: 290,704

[22] Filed: Dec. 23, 1988

[51] Int. Cl.[5] ..... C23F 13/00

[52] U.S. Cl. ..... 204/196; 204/147; 204/286; 204/290 F; 204/297 R

[58] Field of Search ..... 204/147, 148, 196, 197, 204/286, 297 R, 290 F

[56] References Cited

U.S. PATENT DOCUMENTS

| | | | |
|---|---|---|---|
| 2,187,143 | 1/1940 | Bary | 204/196 |
| 3,409,530 | 11/1968 | Locke et al. | 204/196 |
| 3,598,715 | 8/1971 | Goens et al. | 204/290 F |
| 3,718,554 | 2/1973 | Jacobs et al. | 204/196 |
| 4,171,254 | 10/1979 | Koenecke | 204/290 R |
| 4,713,159 | 12/1987 | Truitt et al. | 204/197 |
| 4,798,657 | 1/1989 | Kochilla et al. | 204/196 |

*Primary Examiner*—T. Tung

*Attorney, Agent, or Firm*—Renner, Otto, Boisselle & Sklar

[57] ABSTRACT

A cathodic protection system for metal water tanks in which one or more anodes are attached to a buoyant suspension unit. The suspension unit is secured by guys to both the walls and the floor of the tank, thus minimizing ice damage and system incapacity during winter months. The buoyant suspension unit is formed by individual flotation buoys joined in a dual, concentric ring connection pattern, allowing efficient and effective use of wire type anodes. The geometry of the suspension system is designed to keep the anode off the floor and to maintain the anode in the approximate vertical center of the body of water between normal high and low water levels. An ice protecting cap is positioned over the lead inlet. The dual concentric ring provides a more stable system, but also enables the lead connections to extend around the outer ring avoiding both electrical and mechanical interference with the anode wire.

15 Claims, 2 Drawing Sheets

WATER TANK CATHODIC PROTECTION SYSTEM

The invention generally relates to a cathodic protection system for water tanks.

BACKGROUND OF THE INVENTION

Water tanks, clarifiers and other similar water works tanks are constant targets of corrosion from the moment of installation. Effective and continuous steps must be taken to prevent corrosion or the result is costly replacement and repairs long before the expiration of the equipment's design life. Cathodic protection has become an important and accepted weapon in this battle against corrosion.

The corrosion of submerged metallic structures is caused by electrochemical activity. A metal surface in contact with an electrolyte, such as water, will normally contain both anodic and cathodic areas. In the cathodic areas, electric current flows from the electrolyte onto the metallic structure. The opposite electrical path is followed in anodic areas. The current flows from the metal to the electrolyte. Corrosion only occurs in anodic areas, where the current flows from, rather than to, the tank's interior surface. This particular electrical path sets the stage for the chemical formation of corrosion products. Cathodic protection prevents corrosion by assuring all areas of the metal's surface are cathodic, and none are anodic.

The impressed current method is the most common kind of cathodic protection used in water tanks. Direct current is sent through anodes suspended in the liquid, establishing a current flow from the anode, through the liquid, through the tank wall and to the ground. When the amount of current is adjusted properly, it overpowers corrosion current discharged from all anodic areas of the structure. The result is a net current flow onto all areas of the metal, the entire surface therefore being cathodic and safe from corrosive chemical activity.

To obtain the desired results the anodes must be mechanically suspended in the liquid to allow the electric current to flow through the water to the tank. In addition, the anodes must be arranged to achieve an even distribution of the cathodic protection current.

Winter weather is one of the worst enemies of a water tank cathodic protection system. Ice accumulates in the tank, often quickly and in quite comprehensive proportions in colder climates. In Canada and Alaska, for example, water will freeze one inch every twenty-four hours in a stagnant tank. Any exposed item is subject to damage due to direct accumulation. Additionally, in the correct conditions, the ice may rip away from the interior wall of the tank any attached fixtures such as support devices or eyelets for guys for cathodic protection systems.

Spring, and its warmer weather, may complicate rather than cure the ice accumulation conditions. With rising temperatures, the ice thaws and may break away from the side of the tank. When the ice drops, it may damage anything in its falling path, including cathodic protection systems.

Cathodic protection systems have been developed in which both the anodes and the supporting devices are submerged beneath water level. While submerged suspension systems may perhaps prevent the problems of direct accumulation and dropping ice, these systems are still susceptible to seasonal damage. The submerged systems may be of two basic designs, and in both designs wall supports are the only means of securing the system to the tank. In one design, the system is buoyant and secured to the tank by flexible wall supports or guys. In another design, the nonbuoyant submerged suspension system is secured to the tank by stable wall supports. When ice rips off the securing supports from the tank walls, the buoyant systems will float to the top hitting surface ice, while nonbuoyant systems will sink to the tank bottom. Therefore, despite the improvement made over roof-supported systems, the submerged suspension systems may still be victimized by ice damage in cold climates.

In addition to winter weather, the introduction of platinized niobium wire anodes has made conventional cathodic protection systems incompatible with current corrosion control needs. This anode material has a life span of 30 to 50 years, and is considered permanent because the wire will usually outlast the tank itself. Permanent anode wire is therefore more economic than traditional anodes which may require frequent replacement.

The advantages anode wire offers over other types of anodes has accounted for its increased use in protective systems. Along with the advantages, however, additional demands are placed on the corrosion control system, and some suspension systems of prior art are unsuitable. One added demand is that an anode wire suspension system's design must assure the anode material not come into contact with the tank during normal fluctuations in the water. The anode wire, being touch sensitive, also should not be allowed to contact surface ice in colder climates. Therefore, the prior art suspension systems susceptible to losing wall supports during the winter months are inadequate for long lived wire anode systems.

Another additional burden placed on the suspension system is that the anode wire should receive a connection from a current source every 10 amps or so many feet of wire. The present practice is to wrap feeder wire, which supplies the electrical current, around the anode wire. While this design enables the electrical connection to be made at required intervals, it has several disadvantages. The wrapping results in the feeder wire touching and covering a significant part of the anode wire's surface area. With each movement of water, a frequent occurrence in a tank in which the liquid level fluctuates often, platinum may be rubbed off the anode reducing the wire's effectiveness. Even in completely calm waters, the feeder wire is constantly shielding the current discharging from the anode. Furthermore, installation of the system may be complicated by the tendency of the two wires to become tangled with each other.

Examples of prior art buoyant systems referred to above may be seen in prior U.S. Pat. No. 3,718,554, and the PERMANODE® system marketed by Harco Technologies Corporation of Medina, Ohio, under such patent. The latter utilizes a single ring rope held in position by guys extending radially to the side wall of the tank, with buoys attached to the guys. If ice damage occurs to the guy anchors or to the electrical leads entering through the wall of the tank the system is apt to fail. Repair or replacement of the system may then require the tank to be emptied which can be costly as well as incovenient.

SUMMARY OF THE INVENTION

A cathodic protection system for metal water tanks in which one or more anodes are attached to a buoyant suspension unit. The suspension unit is secured by guys to both the walls and the floor of the tank, thus minimizing ice damage and system incapacity during winter months. The buoyant suspension unit is formed by individual flotation buoys joined in a dual, concentric ring connection pattern, allowing efficient and effective use of wire type anodes. The geometry of the suspension system is designed to keep the anode off the floor and to maintain the anode in the approximate vertical center of the body of water between normal high and low water levels. An ice protecting cap is positioned over the lead inlet. The dual concentric ring provides not only a more stable system, but also enables the lead connections to extend around the outer ring avoiding both electrical and mechanical interference with the anode wire.

A cathodic protection system for all climates is achieved by the invention's novel attachment of the system to the tank. A buoyant suspension unit is secured by guys to both the floor and the walls of the tank. Although the system has a double connection, the floor supports alone are sufficient to keep the buoyant unit submerged. The floor supports are normally free from ice damage. Thus, the protective system remains operative and effective even if the wall supports are damaged by ice.

A cathodic protection system compatible with anode wire is accomplished by the invention's unique construction of the system's buoyant suspension unit. A number of individual flotation buoys are connected between two concentric ring ropes to form the suspension unit. The anode wire may be attached to the inner rope and the feeder wire may be strung along the outer rope. The dual rope arrangement allows the feeder wire to cross to the inner rope only at required electrical intervals. Thus necessary current connections can be made without wrapping the feeder wire around the anode wire.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DESCRIPTION OF THE PREFERRED EMBODIMENTS

Figure 1:
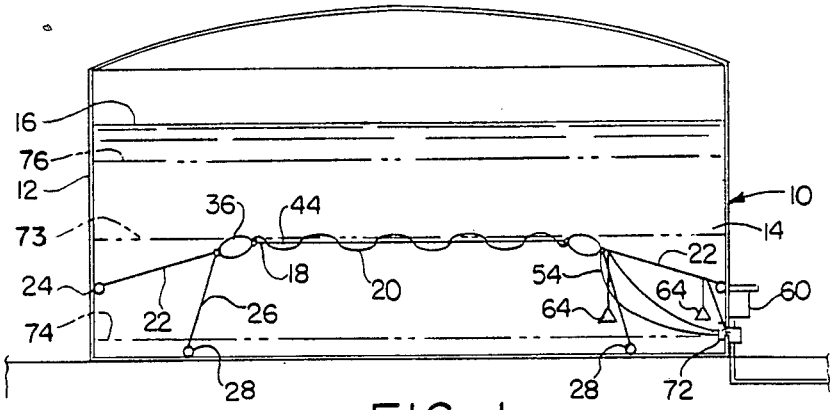
FIG. 1 is a schematic vertical section of the water tank and the buoyant submerged system attached to the tank by guy lines.
Figure 2:
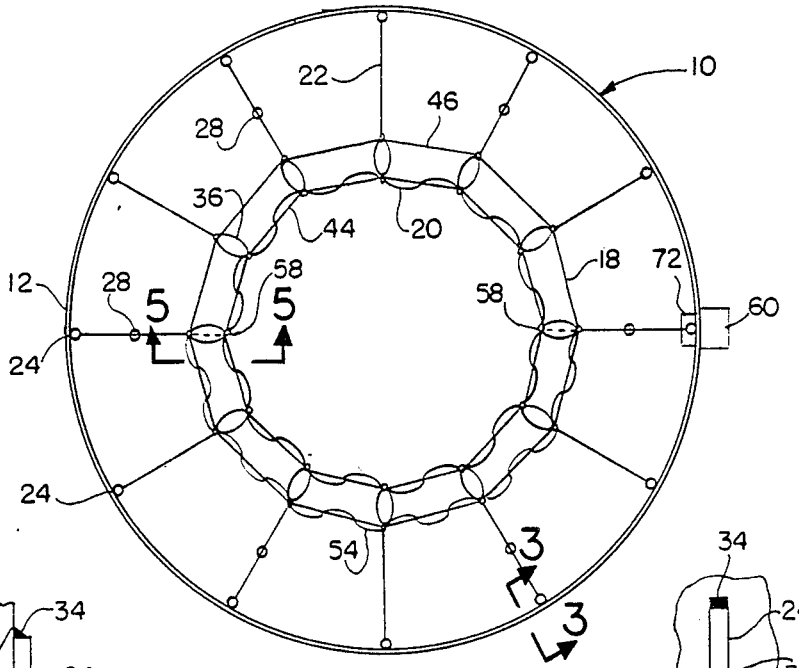
FIG. 2 is a top view of the water tank and cathodic protection system.

Referring first to FIGS. 1 and 2, cathodic protection system 10 is shown situated in metal tank 12. Water, or any other ionic liquid 14 fills tank 12 up to level 16. Although tank 12 is a circular cylinder, a tank of any configuration or size can be accommodated by the present invention.

Cathodic protection system 10 comprises a nonconducting buoyant annular suspension unit 18, to which anode material or wire 20 is attached. The wire is preferably a platinized niobium anode wire. Suspension unit 18 is secured to the tank 12 wall by nonmetallic guy lines 22 at wall supports 24. Nonmetallic guy lines 26 secure unit 18 to the floor of the tank at floor supports 28. These guy lines prevent system 10 from floating up to liquid level 16 due to the suspension system buoyancy. Accordingly, suspension unit 18 must be of sufficient buoyancy not only to overcome its own nonbuoyant portions, but also the weight of securing guy lines 22 and 26.

Figure 3:
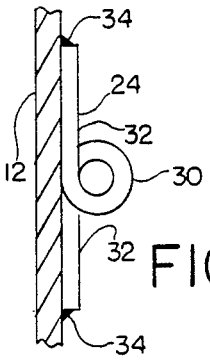
FIG. 3 is an enlarged fragmentary sectional view taken on line 3—3 of FIG. 2 showing an eye wall support.
Figure 4:
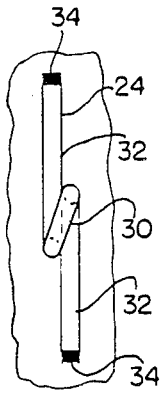
FIG. 4 is a side view of the wall support seen from the right hand side of FIG. 3.

The wall supports 24 and the floor supports 28 may be of identical design. FIGS. 3 and 4 shown a steel eye ring wall support 24, which would be equally adaptable for floor support 28. The support is in the form of a rod bent to form ring 30 and two oppositely extending straight sections 32. The eye 24 is welded to the tank at 34 and connecting guy line 22 may be threaded through ring 30 and knotted or otherwise fastened to the support. The guy lines 22 and 26 may be a suitable non-conducting plastic rope.

The number of wall and floor eyes or anchors may vary according to the needs of the system. A symmetrical pattern is recommended to assure the system is centrally located in the tank. In this way, the attached anode may be more easily arranged to achieve an even distribution of the protecting current.

In FIG. 1 the system 10 is at its most elevated position. The length of guys 22 and 26 limits the system's maximum vertical elevation to this level. Even if wall guy lines 22 were suddenly unable to secure buoyant suspension unit 18 to the wall of tank 12, floor guy lines 26 would prevent the unit from floating to the top and contacting surface ice.

Figure 5:
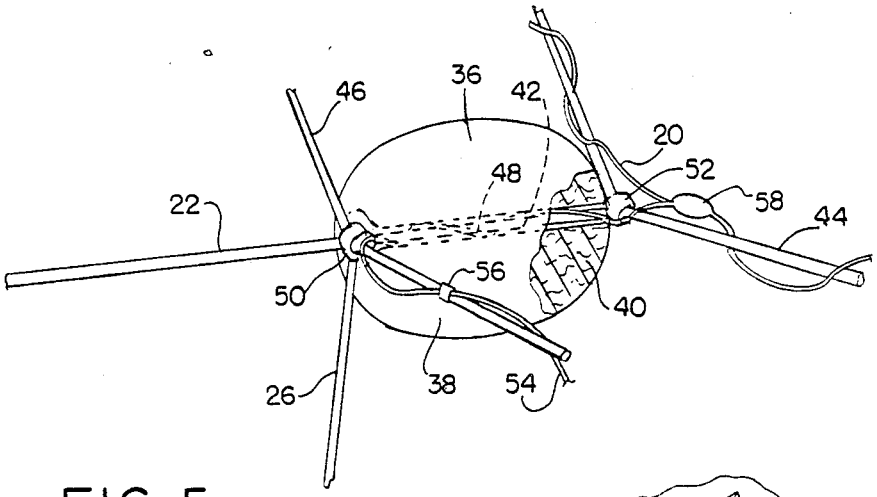
FIG. 5 is an enlarged broken view taken from line 5—5 of FIG. 2 showing a flotation buoy.
Figure 6:
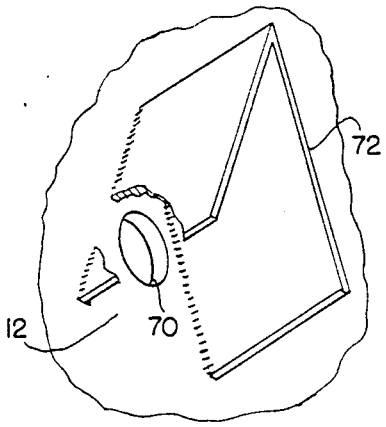
FIG. 6 is an enlarged view of the entrance fitting and the interior protective covering.
Figure 7:
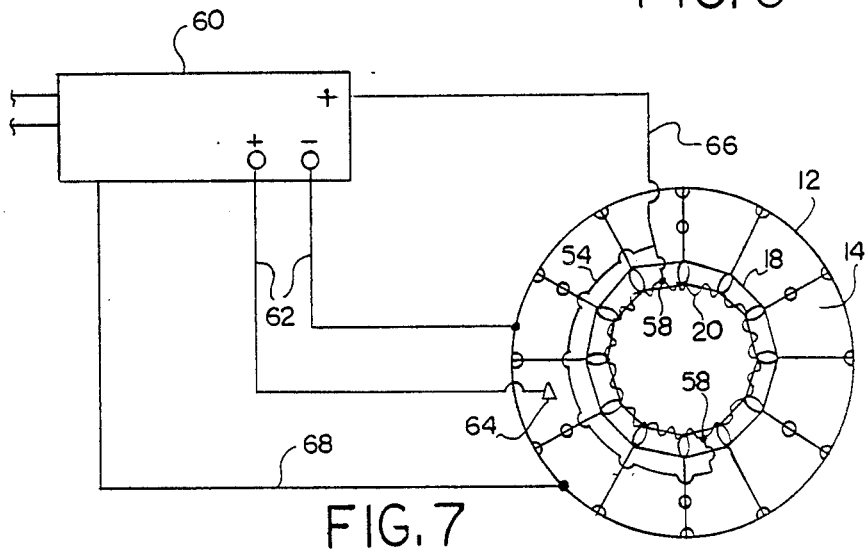
FIG. 7 is an electrical schematic superimposed upon a mechanical representation of the cathodic protection system.

Buoyant suspension unit 18 contains a number of individual flotation foam plastic buoys 36. As is best seen in FIG. 5, the football shaped flotation buoy 36 in the preferred embodiment has an outer non-porous shell 38 and a foamed interior 40. Buoy 36 also has central axial opening 42.

Individual flotation buoys 36 are joined together in a dual concentric arrangement by flexible nonmetallic ropes. In the preferred embodiment, inner ring rope 44 joins the inner ends of buoys 36 to each other in a closed circular path. Likewise, outer ring rope 46 joins the outer ends of buoys 36 to each other in a second, slightly larger closed circular path. The two ring ropes 44 and 46 are joined to each other by radially extending connector ropes 48. Connecting ropes 48 run through the central opening 42 of each buoy 36 and are knotted with the two ring ropes at 50 and 52. In the embodiment shown, wall guy lines 22 and floor guy lines 26 are also connected at the outer end of each buoy 36 at knot 50.

As seen in FIG. 2 there are twelve buoys 36 equally circumferentially spaced and twelve respective guy lines 22 connected to the side wall of the tank each of the same length. However the floor guy lines 26 may extend downwardly to eyes 28 from the outer end of every other buoy 36. Thus there are only six equally spaced floor guy lines. The larger number of wall guy lines contributes to maintaining the integrity of the system should one be damaged.

An important feature of the dual connecting ring ropes is that two separate, circular and concentric paths are formed. The anode wire 20 is wrapped around the inner ring rope 44. The outer ring rope 46, and also the buoys 36 shield the inner anode wire from unwanted contact with surrounding tank 12.

The dual concentric ring ropes also allow a more efficient electrical connection to the anode wire. A feeder wire 54 is wrapped around outer ring rope 46 and may be additionally secured with clips 56. As best seen in FIG. 5, feeder wire 54 is threaded through central opening 42 of buoy 36 at required intervals. When feeder wire 54 exits buoy 36, an electrical connection is made at 58 with anode wire 20. While the preferred embodiment shows only two electrical connections 180° apart, any number of needed connections could be made through any buoy 36.

The impressed current system includes an automatic control device and rectifier 60, which continuously monitors the condition of tank 12. A circuit 62 is incorporated in control device 60 which calculates cathodic current needs based on reference electrode 64 readings. Direct current through supply lead 66 is then increased or decreased to compensate for tank protection requirements. Direct current is supplied through lead 66 to feeder wire 54 which connects with anode wire 20 at 58. A current flow is then established from anode 20, through liquid 14, through tank 12 and to electrical ground 68.

Using the impressed current method requires leads enter tank 12 from the rectifier. If the system includes reference electrode 64 its electrical lead must likewise enter tank 12. These wires are brought in through entrance fitting 70, located slightly above the floor of tank 12. Entrance fitting 70 is shielded on three sides by protective inverted V-shape covering or roof 72, which may be welded to the interior of the tank, further protecting the system from winter ice damage.

Referring again to FIG. 2 system 10 will remain in its most elevated position until the liquid level drops below phantom line 73. The system will then float until the liquid level reaches phantom line 74. At this liquid level, the dimensions of the wall guy lines 22 and buoyant suspension unit 18 restrict the system. Specifically, the radius of unit 18 and the length of guy lines 22 prevent the system from dropping any lower. The eyes 24 are halfway between levels 73 and 74. Therefore, regardless of the liquid level, the anode will not contact the bottom of tank 12. At the position shown in FIG. 2 the anode is in the approximate center of the body of water in the tank as the tank level fluctuates between level 16 and level 76, which may be such normal fluctuation.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A cathodic protection system for protecting a metal water tank containing a liquid and having a wall and floor against corrosion including anode means and associated electrical conductor means attached to a nonconducting support means, said support means having a positive buoyancy in relation to the liquid, said buoyant support means and attached anode means being submerged in the water tank, means to impress a direct current to said associated electrical conductor from a power source, said buoyant means being attached to the tank at both floor and wall locations, wherein said buoyant support means comprises inner and outer annular ropes separated by flotation means, and wherein said associated electrical conductor is supported by the outer annular rope and the anode is in the form of a wire supported by the inner annular rope.

2. A system according to claim 1 wherein said buoyant support means is attached to the floor by plastic rope.

3. A system according to claim 2 wherein said buoyant support means is attached to the wall by plastic rope.

4. A system according to claim 3 including eye rings secured to the wall and floor to which said ropes are secured.

5. A system according to claim 3 wherein said plastic ropes are dimensioned so that said anode means cannot contact the floor of the tank regardless of water level.

6. A system according to claim 1 including a plurality of radial electrical connections between said conductor and anode.

7. A system according to claim 6 wherein said associated electrical conductor has a feed wire entering the tank through an entrance fitting, said entrance being shielded by a protective covering.

8. A system for cathodically protecting a metal water tank containing a liquid and having a floor and wall against corrosion including anode means and an associated electrical conductor attached to a nonconducting support means, said support means having a positive buoyancy in relation to the liquid, said buoyant support means and attached anode means being submerged in the water tank, and means to impress a direct current to said associated electrical conductor from a power source, said buoyant support means comprising inner and outer ring means separated by flotation means, wherein said anode means is a wire wrapped around said inner ring means, and wherein the associated electrical conductor includes a feed wire which travels along the outer ring means, only connecting the anode means at spaced electrical connection points.

9. A system according to claim 8 wherein said flotation means comprises individual flotation devices equally spaced around said ring means.

10. A system according to claim 9 wherein the individual flotation means are foam filled buoys with a central opening, and radially extending connectors for said ring means extending through said openings.

11. A system according to claim 10 wherein said buoyant support means is attached to the tank at both floor and wall locations.

12. A system according to claim 8 wherein the wire anode is platinized niobium wire.

13. A system according to claim 12 wherein the feed wire enters the tank through an entrance fitting, said entrance being shielded by a protective covering.

14. A system according to claim 13 including wall and floor anchors attached to the outer ring means.

15. A system for cathodically protecting a metal water tank containing a liquid comprising anode means and an associated electrical conductor attached to a nonconducting support means, said support means having a positive buoyancy in relation to the liquid, said buoyant support means and attached anode means being submerged in the water tank, and means to impress a direct current to said associated electrical conductor from a power source, said associated electrical conductor including a feeder wire entering the tank through an entrance fitting, said entrance fitting being shielded by protective covering, wherein said buoyant support means comprises inner and outer annular ropes, and wherein the electrical conductor is supported by the outer annular rope and said anode is in the form of a wire supported by the inner annular rope.

* * * * *